US009340257B2

(12) United States Patent
Ulgen

(10) Patent No.: US 9,340,257 B2
(45) Date of Patent: May 17, 2016

(54) TRIM STABILIZER DEVICE HAVING ADJUSTABLE FOIL FOR SPEED BOATS

(71) Applicant: Mehmet Nevres Ulgen, Istanbul (TR)

(72) Inventor: Mehmet Nevres Ulgen, Istanbul (TR)

( * ) Notice: Subject to any disclaimer, the term of this patent is extended or adjusted under 35 U.S.C. 154(b) by 12 days.

(21) Appl. No.: 14/473,047

(22) Filed: Aug. 29, 2014

(65) Prior Publication Data

US 2015/0367912 A1 Dec. 24, 2015

(30) Foreign Application Priority Data

Jun. 18, 2014 (TR) ..... 2014/07101

(51) Int. Cl.

| | |
|---|---|
| ***B63B 1/26*** | (2006.01) |
| ***B63B 1/28*** | (2006.01) |
| ***B63B 1/24*** | (2006.01) |
| ***B63B 39/06*** | (2006.01) |
| ***B63B 43/04*** | (2006.01) |

(52) U.S. Cl.

CPC ..... *B63B 1/285* (2013.01); *B63B 1/242* (2013.01); *B63B 1/26* (2013.01); *B63B 39/061* (2013.01); *B63B 43/04* (2013.01)

(58) Field of Classification Search

CPC ..... B63B 1/30; B63B 1/283; B63B 1/285; B63B 1/242; B63B 1/28

See application file for complete search history.

(56) References Cited

U.S. PATENT DOCUMENTS

| | | | | |
|---|---|---|---|---|
| 2,985,130 | A | 5/1961 | Jacobs et al. | |
| 3,062,167 | A | 11/1962 | Bennett | |
| 3,769,927 | A | 11/1973 | Carney | |
| 4,077,353 | A * | 3/1978 | Webb, Jr. ..... | B63H 20/10 248/641 |
| 5,029,800 | A * | 7/1991 | Ponican ..... | B63H 20/06 248/241 |
| 2013/0167766 | A1 | 7/2013 | Ulgen | |

* cited by examiner

*Primary Examiner* — Edwin Swinehart
(74) *Attorney, Agent, or Firm* — Vidas, Arrett & Steinkraus

(57) ABSTRACT

A trim stabilizer device to be communicated with a transom of a motor boat includes a foil tiltable around its transversal axis and the foil is structurally independent from the transom. An actuator communicates with the foil for tilting. A slide mechanism communicates with the actuator for making a translatory motion thereof relative to the transom. A disc having at least one guide groove guides the slide member; and a connecting member connects the trim stabilizer device to the transom, the connecting member communicates with the disc.

14 Claims, 15 Drawing Sheets

TRIM STABILIZER DEVICE HAVING ADJUSTABLE FOIL FOR SPEED BOATS

CROSS-REFERENCE TO RELATED APPLICATIONS

This Utility Patent Application claims priority to TR 2014/07101, filed on Jun. 18, 2014.

STATEMENT REGARDING FEDERALLY SPONSORED RESEARCH

Not applicable.

BACKGROUND OF THE INVENTION

The present invention relates to a trim stabilizer device having a foil for speed boats.

The boat position and particular the trim (pitching) of the boat is crucial in terms of cruising performance and fuel economy. Several factors such as load position, speed, the waves and wind in the sea have an effect on trim in motor boats. When the trim of the motor boat increases in relatively fast cruises, mechanical stresses occur on both the hull and the motor as the rear of the boat hull is dragged with high resistance in the sea.

Trim tabs have long been used in speed boats to stabilize the trim. The trim tabs are mounted to the transom of speed boats and they comprise a plate, the bottom surface of which structurally contacts with water, and a mounting part that can be fixed to the transom with which the plate is rotatably communicated by member of a hinge joint. The stabilization of the trim is provided by an actuator (generally a piston) that can make pressure on the tab from the upper side and therefore rotate the tab. It is important how long the trim tabs extend from the bottom end of the boat transom to downwards (towards sea). Thus, as the trim tab is further from the boat to downwards, the counter pressure that the tab stabilizing the boat trim creates is higher, which provides a trim stabilization by pressing the bow of the boat towards the water. However, when trim decreases, as the boat hull will be more in contact with water, the drag and therefore the fuel consumption increase accordingly.

There are many proposals in the art with regard to trim tabs. For instance, U.S. Pat. No. 3,062,167 discloses a trim device which comprises a foil and a concave-formed rod which is communicated with the foil from one side and with trim tabs from the two end sides.

U.S. Pat. No. 2,985,130 discloses a trim tab device that is rotated with the help of a mechanical foil arrangement.

U.S. Pat. No. 3,769,927 discloses trim tabs which can be adjusted independent of each other. The bottom end of an adjustment arm on which a screw is opened is communicated with a bracket on the tab, and as the adjustment arm is rotated, the plate rotates accordingly.

Since the trim tabs of the art are directly communicated with the transom of the boat, water flow along the upper surface of the tab may not be possible. When no trim stabilization is needed, the trim tabs are lifted to transom level or to a higher level (i.e. above the water level); however, this does not contribute to the fuel economy of the boat. The trim tab arrangements according to the art do not allow a height adjustment relative to the boat hull. Furthermore, it may not be possible to tilt trim tabs relative to the transom of the boat. Therefore, cruising performance and comfort are limited in boats equipped with known trim tabs.

BRIEF SUMMARY OF THE INVENTION

An object of the present invention is to provide an effective trim control and fuel economy for speed boats.

Another object of the present invention is to provide a trim control that can make hulls of motor boats having different physical aspects compatible with trim control. By adjusting the trim foil parallel to the angle of transom or to the water surface, different stabilizations and buoyancy forces are provided and that the foils can be safeguarded especially on shallow water.

The invention relates to a trim stabilizer device to be communicated with a transom of a motor boat, said device comprises a foil being tiltable around its transversal axis and the foil being structurally independent from the transom; an actuator communicating with the foil for tilting thereof; a slide member communicating with the actuator for making a translatory motion thereof relative to the transom; a disc having at least one guide groove for guiding the slide member; a connecting member for connecting the trim stabilizer device to the transom, the connecting member communicating with the disc.

According to another aspect, the present invention relates to a motor boat comprising two trim stabilizer devices described above, the trim stabilizer devices being symmetrically communicated with the transom according to the vertical symmetry axis thereof.

According to an embodiment of the present invention, the trim stabilizer device comprises a disc with which the actuator is communicated so that the actuator can make a rotary motion thereof relative to the transom and which can rotate in a circular space formed in the connection part.

BRIEF DESCRIPTION OF THE SEVERAL VIEWS OF THE DRAWINGS

In order for the advantages of the present invention to be understood in the best way possible with its embodiment and the additional elements, it should be assessed together with the figures described in the following.

DETAILED DESCRIPTION OF THE INVENTION

Figure 1:
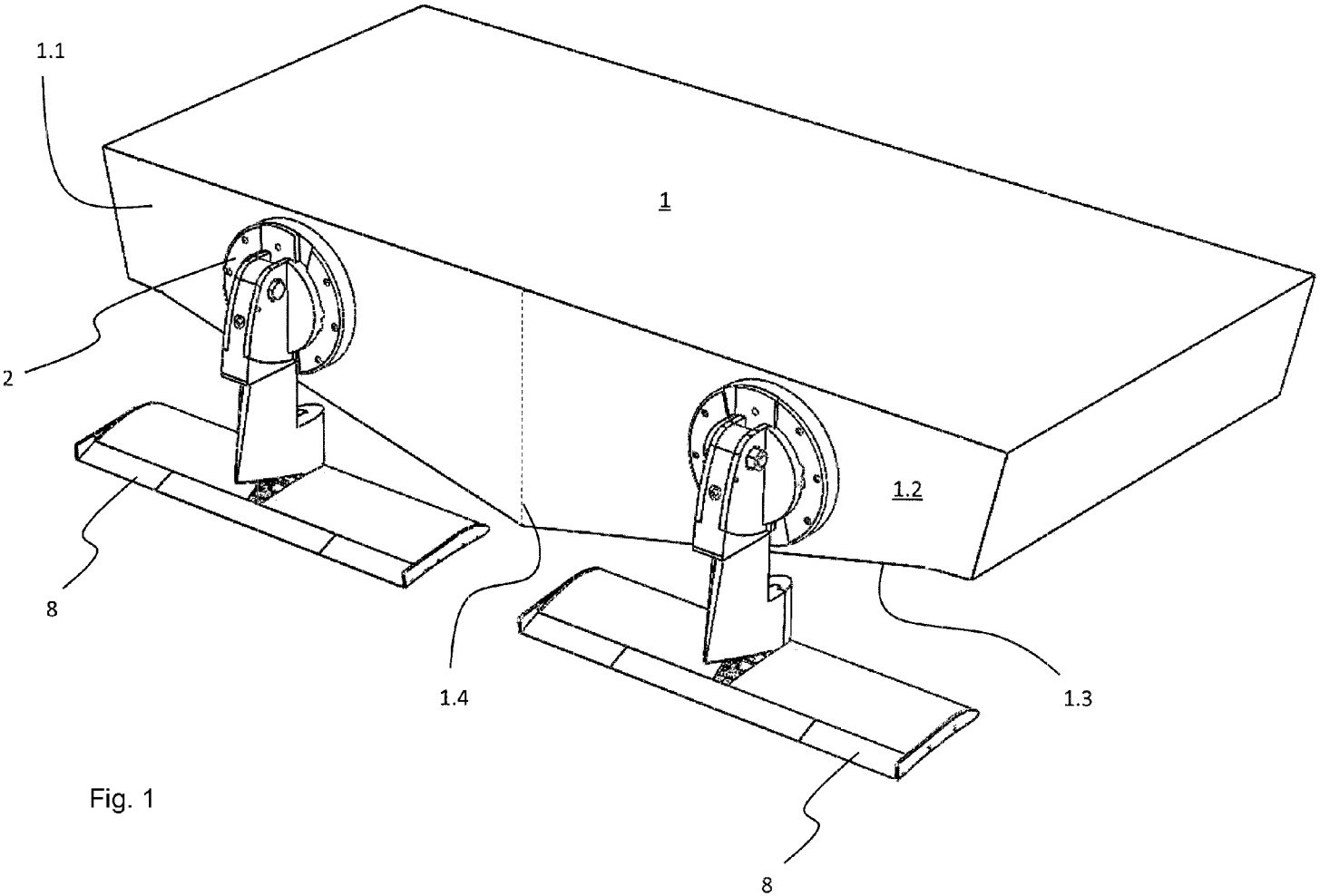
FIG. 1, a pair of trim stabilizer devices mounted to the transom of a boat are shown.

While this invention may be embodied in many different forms, there are described in detail herein a specific preferred embodiment of the invention. This description is an exemplification of the principles of the invention and is not intended to limit the invention to the particular embodiment illustrated.

A foil trim stabilizer device according to the invention is mounted on the surface (1.2) of the transom (1.1) of a motor boat (1) by member of a connecting member such as a bolt. The foil trim stabilizer device comprises a connecting member (2) having preferably an annular form, a sliding member (4) communicated with the connecting member (2), an actuator (9) communicated with the sliding member (4), and a foil (8) being tiltable about its transversal axis by the actuator.

Figure 8:
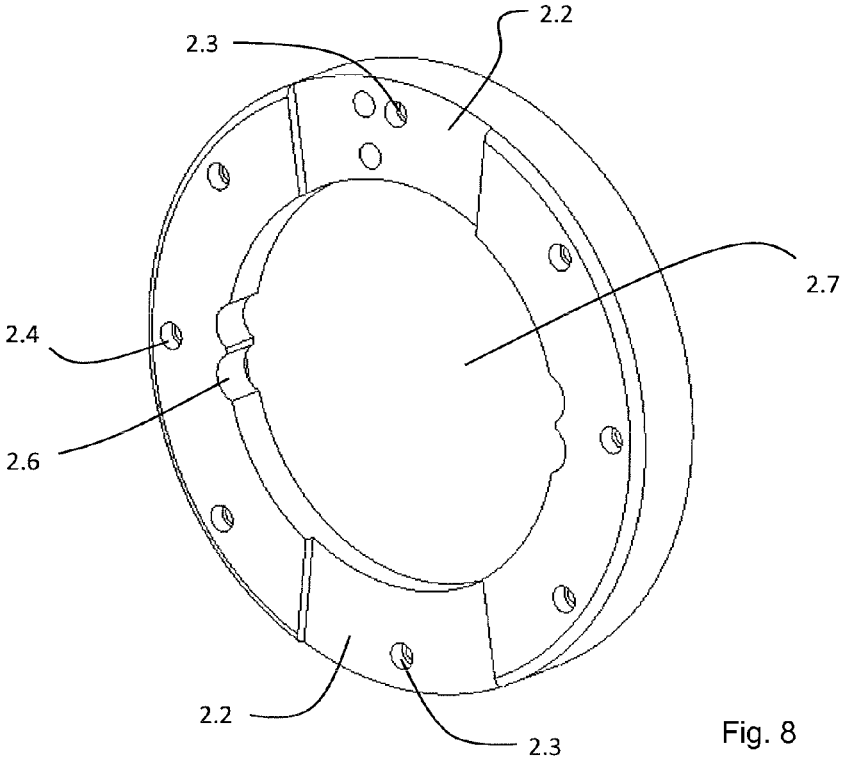
FIG. 8, a front perspective view of the connecting member is shown.
Figure 9:
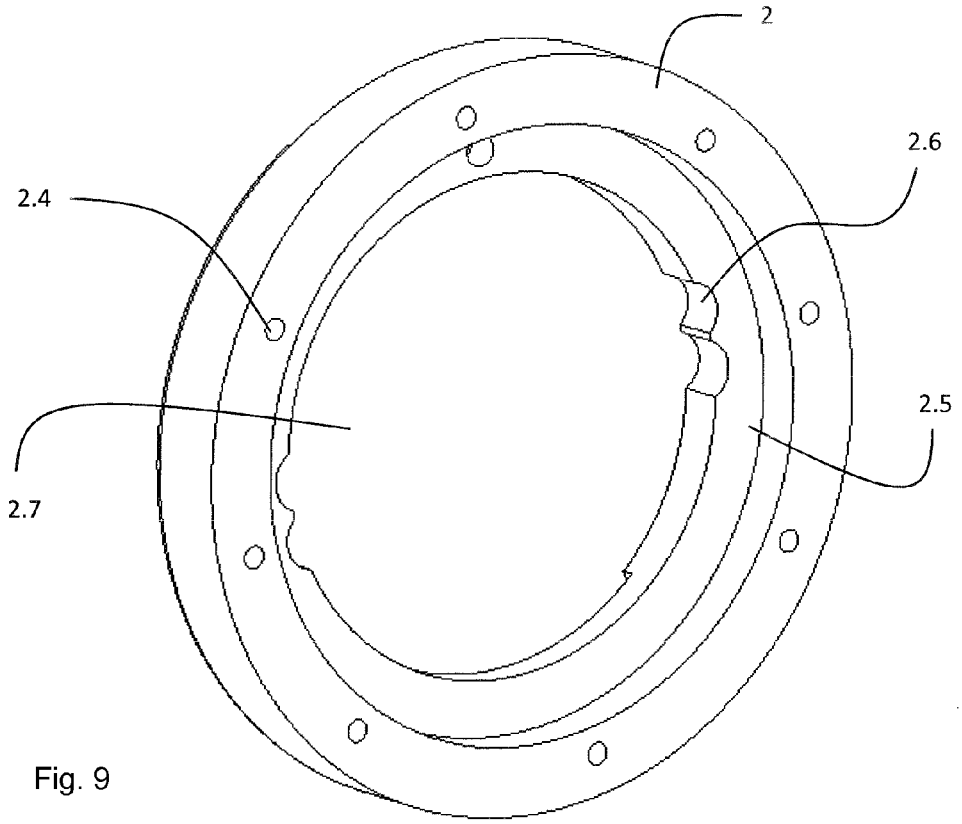
FIG. 9, a rear perspective view of the connecting member is shown.

The connecting member (2) comprises fixing holes (2.4) formed along its thickness as shown in FIGS. 8 and 9. The fixing holes (2.4) are provided with bolts for having the connecting member (2) mounted to the transom (1.1). There is an opening (2.7) in the center of the connecting member (2) and a disc to be described later on is placed in the opening. On the front surface of the connecting member (2), two oppositely formed guide grooves (2.2) are provided. The guide grooves (2.2) have a form of circular segments. The guide grooves (2.2) comprise a plurality of slide fixing holes (2.3) which are formed along the thickness of the connecting member (2). At least one of these slide fixing holes (2.3) is in an annularly offset position compared to the other hole.

Figure 10:
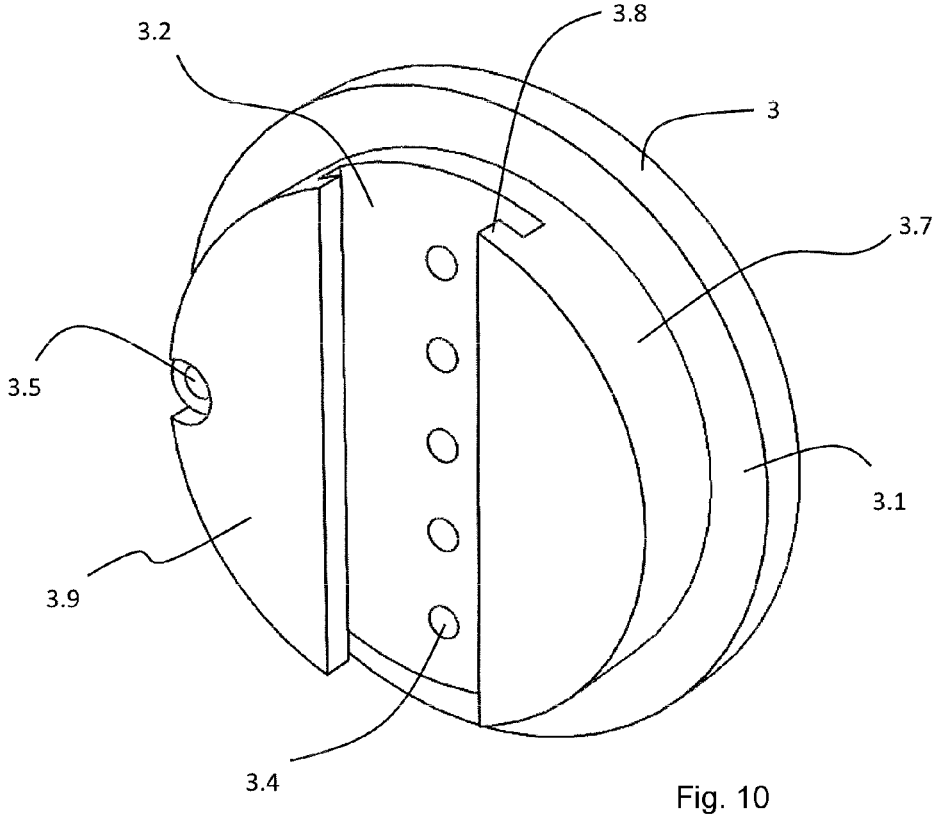
FIG. 10, a front perspective view of the disc is shown.

On the inner diameter periphery of the connecting member (2) (that is on the outer diameter periphery of the connecting member opening (2.7)), two separate pairs of disc fixing grooves (2.6) are formed. One pair of disc fixing grooves (2.6) is essentially in 180° opposite to the other disc fixing grooves. As shown in FIG. 9, a circular disc fitting housing (2.5) is formed on the rear surface of the connecting member (2). A disc (3) as shown in FIG. 10 is placed in the disc fitting housing (2.5) as such the disc fitting surface (3.1) will fit into the disc fitting housing (2.5). The disc (3) comprises a coaxial disc projection (3.7) having a smaller diameter than the disc. A disc guide groove (3.2) is formed along the diameter of the disc projection (3.7).

The disc guide groove (3.2) is formed such a way that it will make some indent through the disc projection surface (3.9) and form a guide groove dent (3.8) on the disc extension surface (3.9). There are provided a plurality of first disc fixing hole (3.4) extending linearly along the surface of the disc guide groove (3.2) and a second disc fixing hole (3.5) on the periphery of the disc extension (3.7).

Figure 11:
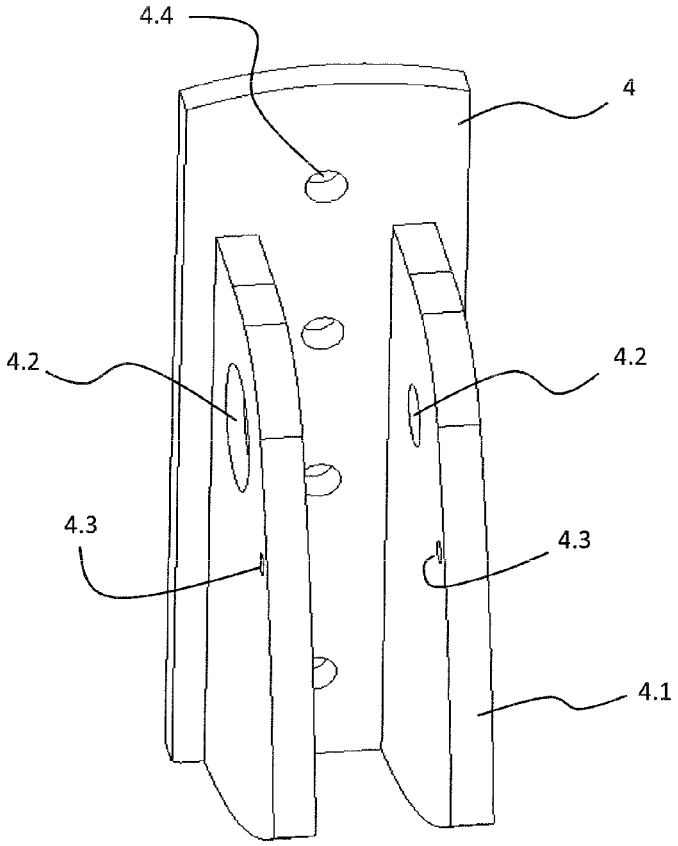
FIG. 11, a perspective view of sliding member is shown.
Figure 16:
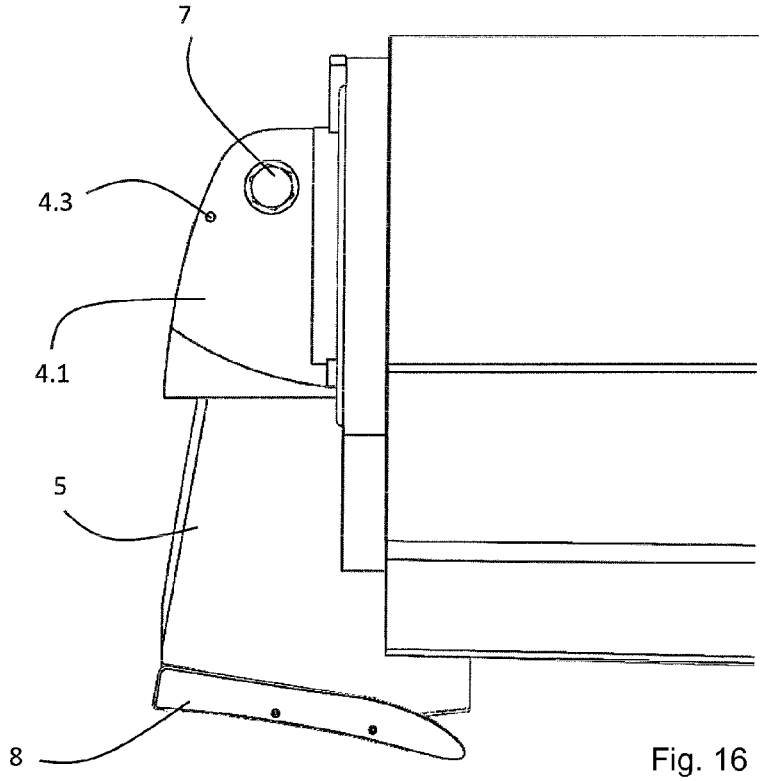
FIG. 16, a side view of the trim stabilizer device mounted to the transom of a boat is shown.
Figure 17:
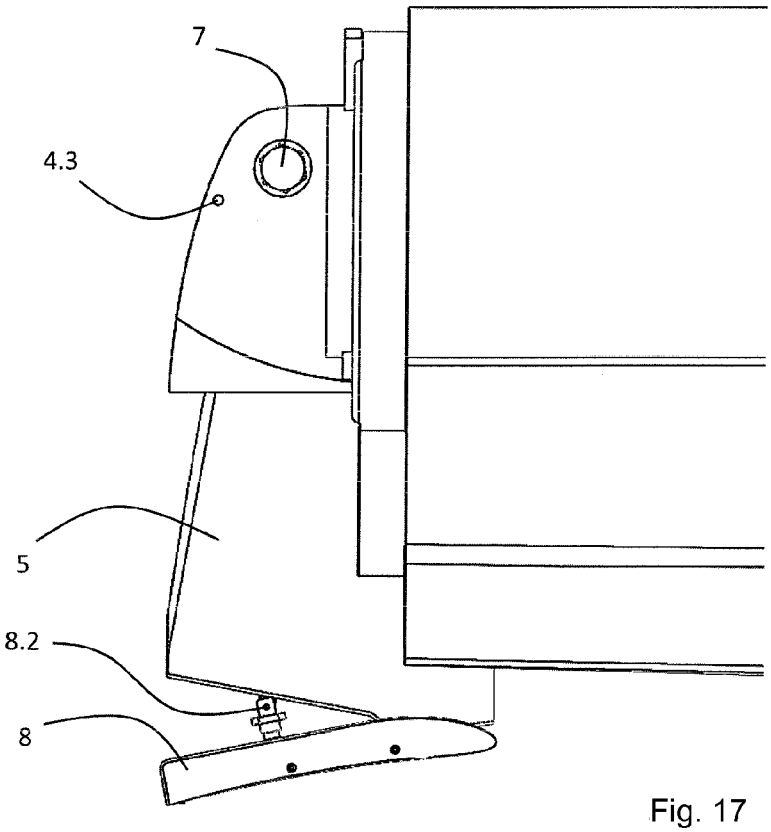
FIG. 17, a side view of the trim stabilizer device mounted to the transom of a boat is shown.
Figure 18:
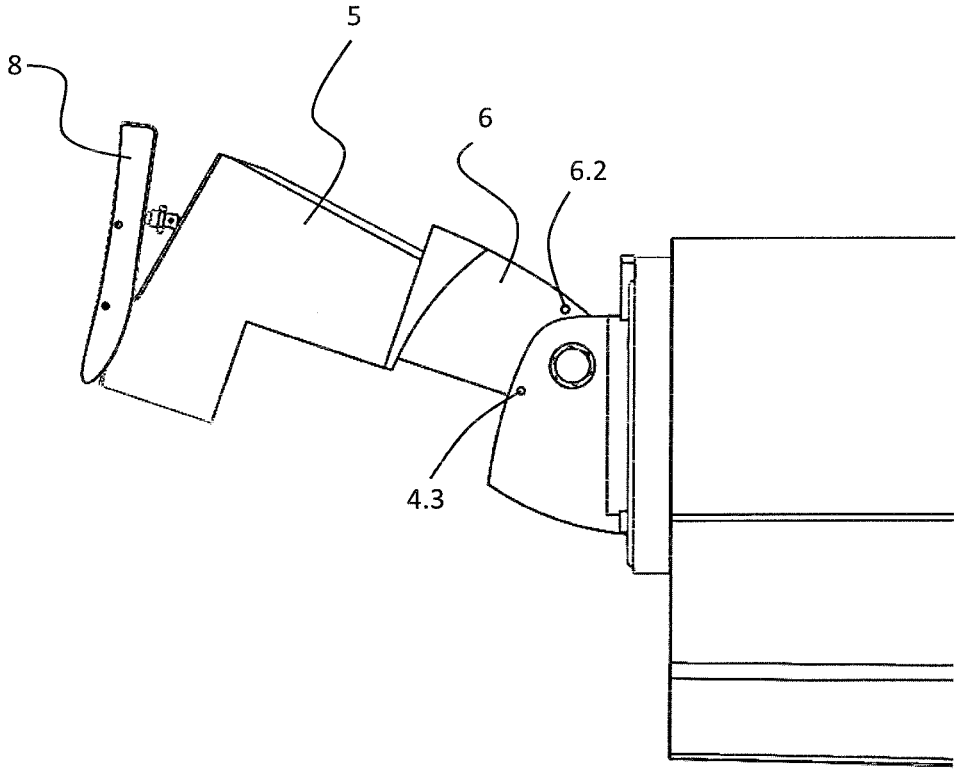
FIG. 18, a side view of the foil when taken out of water is shown.
Figure 19:
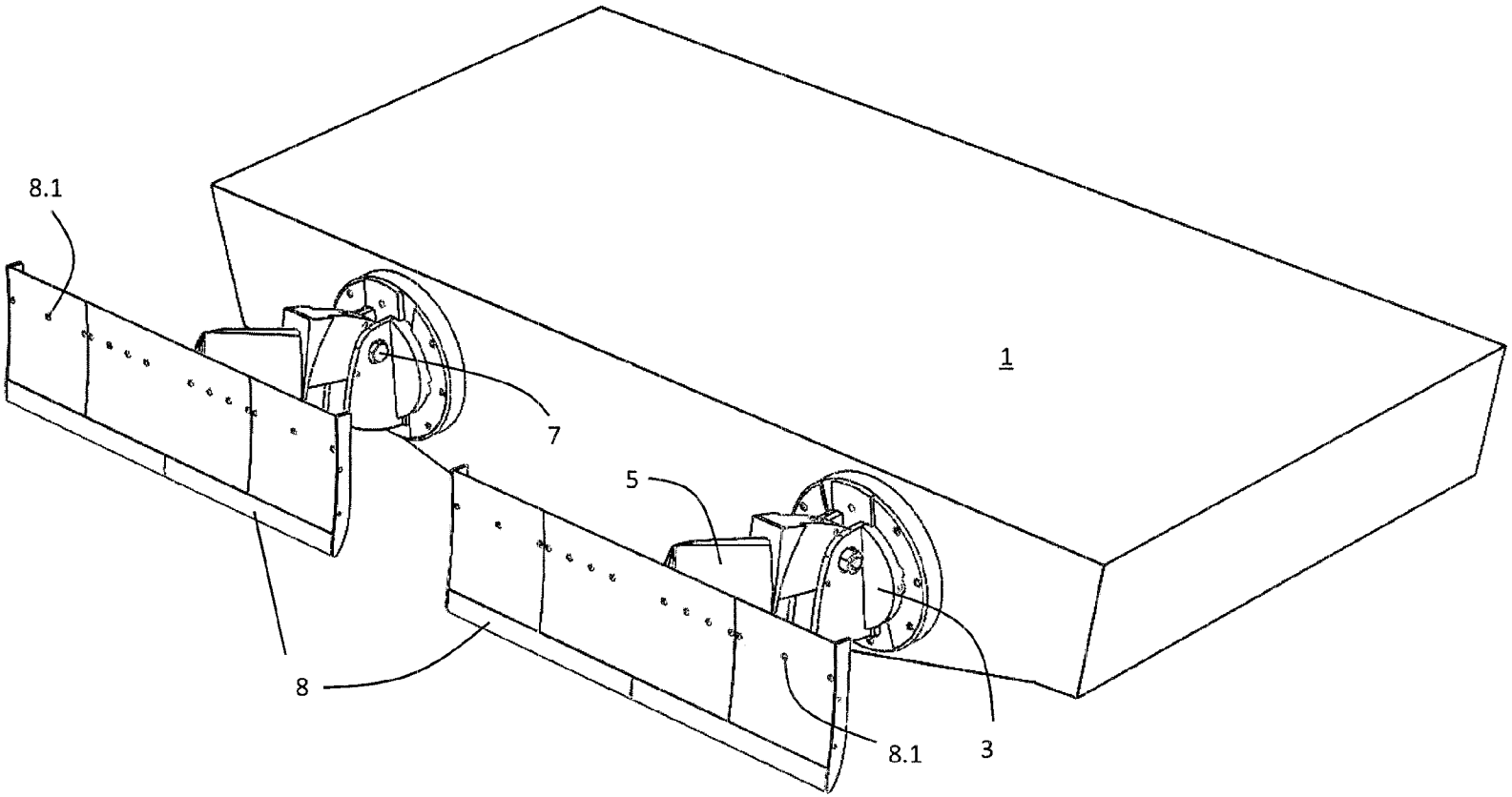
FIG. 19, a perspective view of foils when taken out of water is shown.
Figure 20:
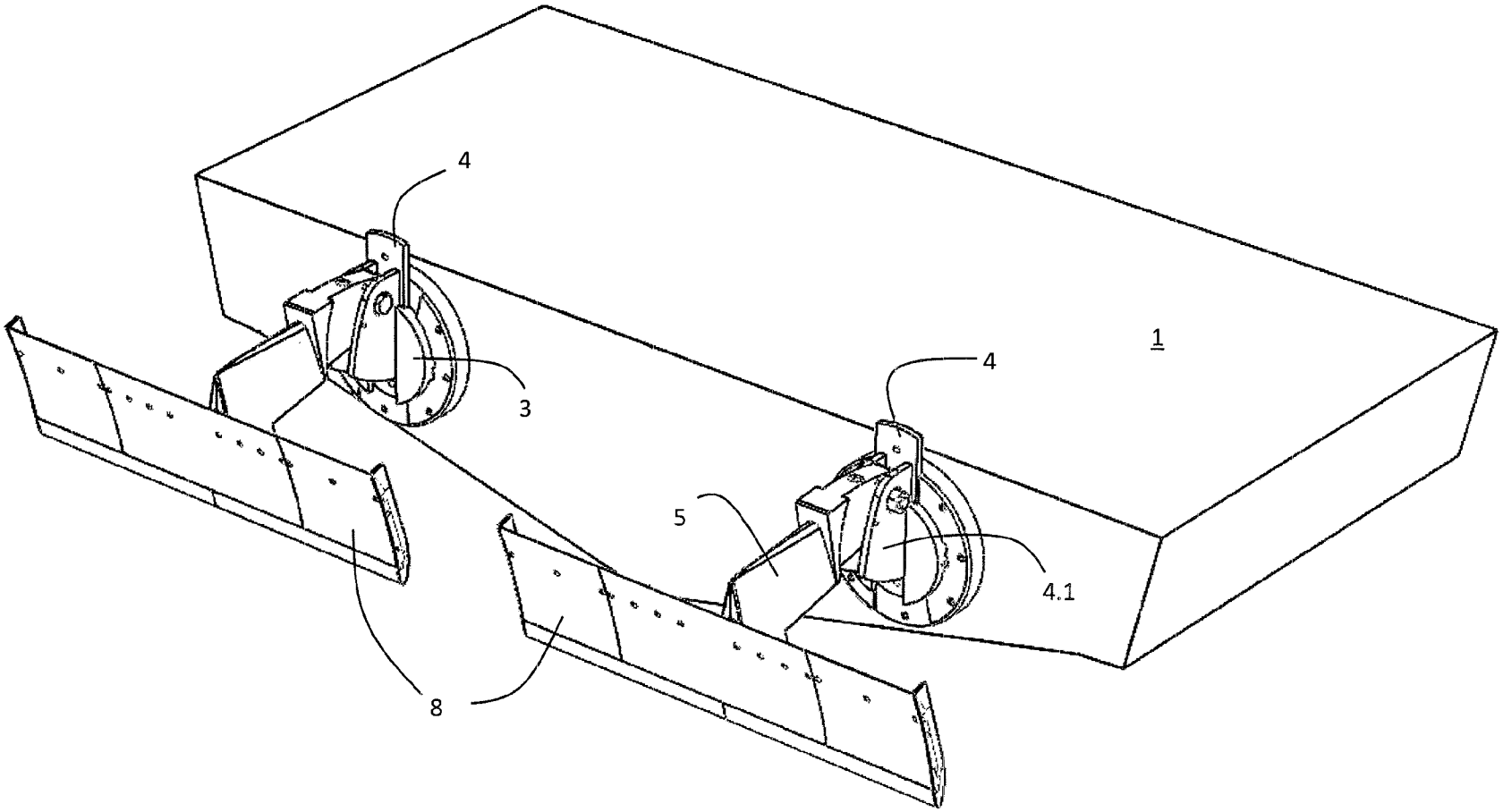
FIG. 20, a view of foils is shown when they are taken out of water and increased to an upper level when translated relative to the transom.

Inside the disc guide groove (3.2) of the disc (3), a sliding member (4) as shown in FIG. 11 is placed. The sliding member (4) has a longitudinal flat form, and a plurality of sliding member fixing holes (4.4) linearly extending along its longitudinal surface are formed on the sliding member (4). On both sides of these sliding member fixing holes (4.4), there are opposite side walls (4.1) extending outward from the surface of the sliding member (4). Along the thickness of the sliding member side walls (4.1), side wall supporting holes (4.2) are oppositely formed and side wall pin holes (4.3) of a smaller diameter are provided. As shown in FIGS. 16 to 18, the external form of the sliding member side walls (4.1) is curvilinear.

Figure 12:
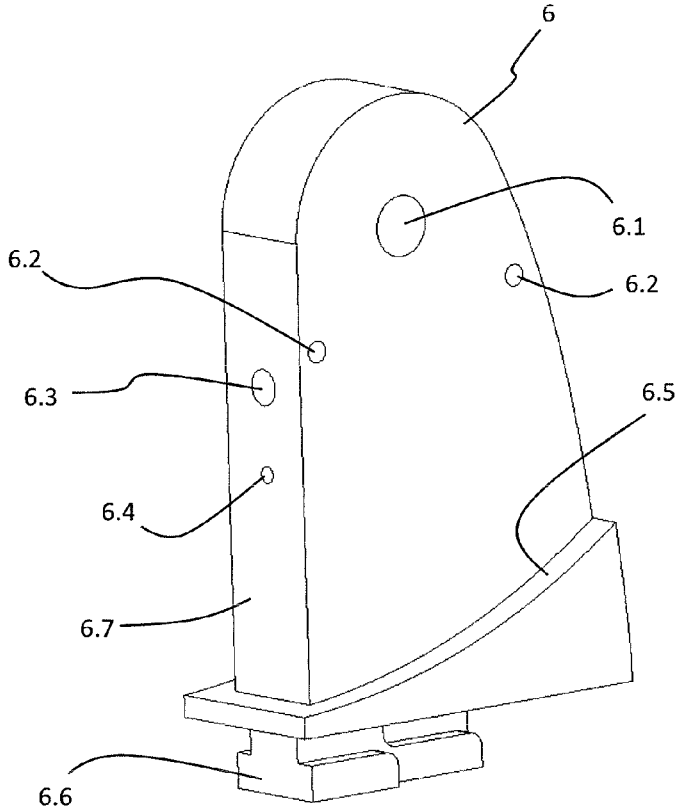
FIG. 12, a perspective view of the case guide connecting member is shown.

In the space left between the sliding member side walls (4.1), a case guide connecting member (6) shown in FIG. 12 is placed. The external form of the case guide connecting member (6) is curvilinear which is compatible with the external form of the sliding member side walls (4.1). The case guide connecting member (6) comprises a connecting member supporting hole (6.1) formed along its thickness and two connecting member pin holes (6.2) formed as separated from one another. On the front part of the case guide connecting member (6), there is a connecting member fitting surface (6.7), and during mounting, this surface is fitted onto the surface of the sliding member (4). On the fitting surface (6.7) of the connecting member, there is provided a guide connection hole (6.3) through the length. On the connecting member fitting surface (6.7), there is provided a connecting member actuator cable hole (6.4), which is projected for the passage of cables providing electricity to an actuator (7) to be described later on.

At the bottom part of the case guide connecting member (6), there is a connecting member fitting surface (6.5) having an arcuate form, and this surface supports the sliding member side wall (4.1) during mounting. At the very bottom part of the case guide connecting member (6), connecting member case connection projections (6.6) are provided. These projections provide the case guide connecting member (6) to be communicated with an actuator case (5) which comprises an actuator (9) inside.

Figure 13:
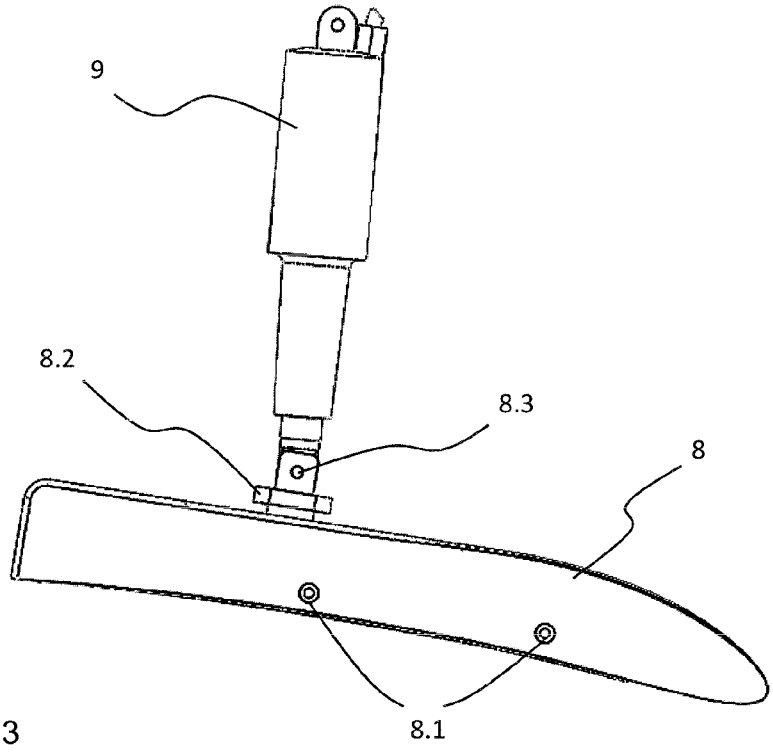
FIG. 13, the foil having its front end in a downward position is shown.
Figure 14:
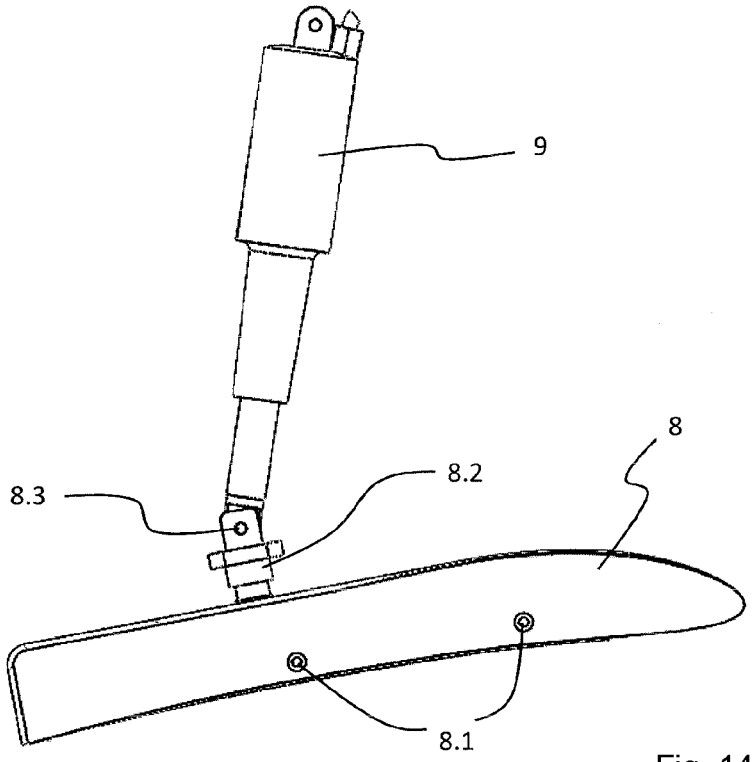
FIG. 14, the foil having its front end in an upward position is shown.
Figure 15:
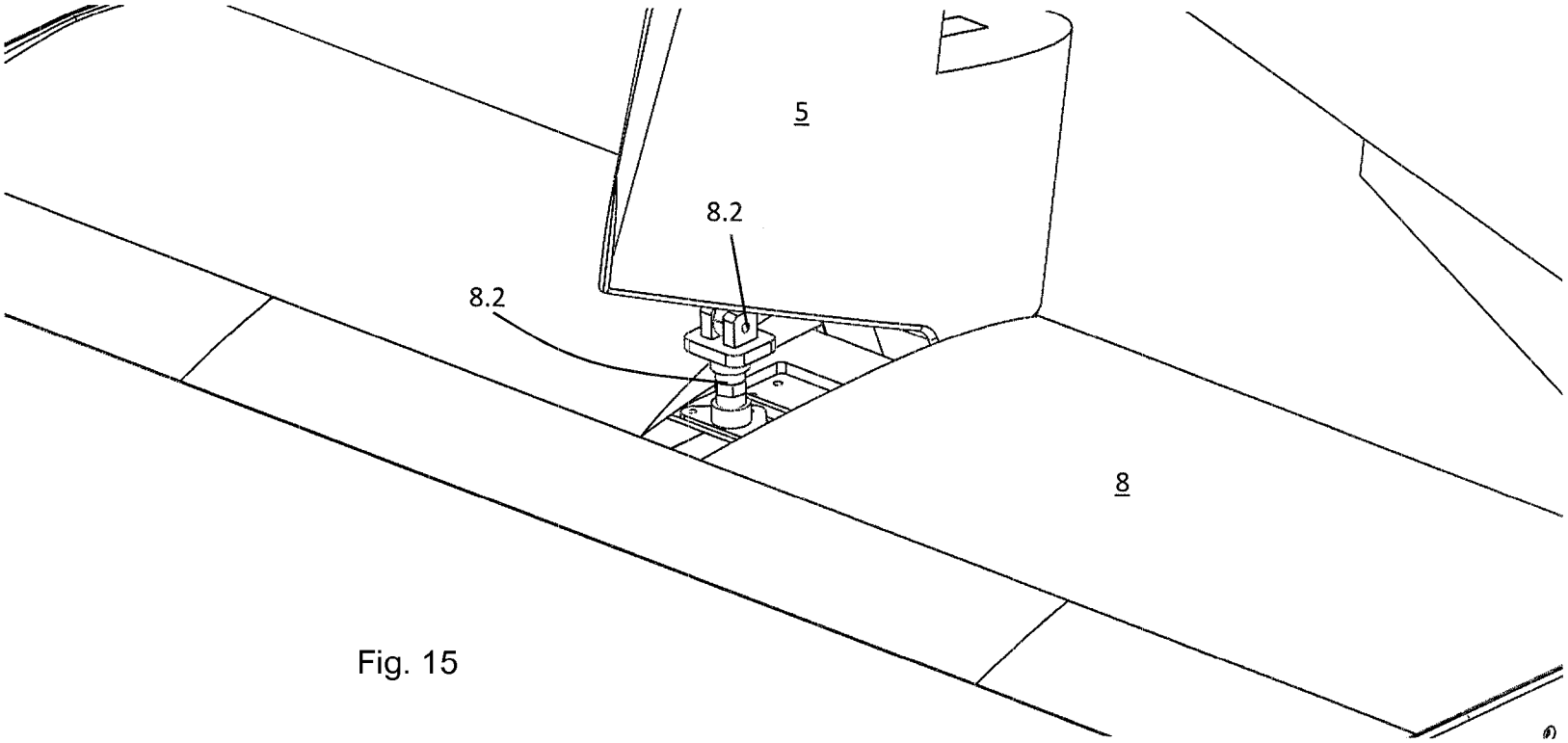
FIG. 15, the connection of the foil and the actuator case is shown.

According to a preferred embodiment of the present invention, the actuator (9) is a piston as shown in FIGS. 13 and 14; and this piston can be hydraulic piston or an electrical operated piston. Actuator piston is communicated at its bottom end with a foil connecting member (8.2) by member of a foil connection pin (8.3). As shown in FIG. 15, the foil connection part (8.2) is a rigid member extending upwards from the inner part of the foil (8). The foil (8) is communicated with the actuator case (5) by member of a rotatable shaft-supporting arrangement which is disclosed in U.S. Pat. No. 13/341,446. As shown in FIGS. 16 and 17, depending on the drive of the actuator (9), the foil (8) can be rotated in a way that its front end will face up or down. When the front end of the foil (8) is in an upward position, trim stabilization is provided; when it is in a downward position, the bottom part of the boat rises up from the water; and as the water resistance decreases, fuel economy is achieved. The foil (8) of the invention can be of any suitable hydrofoil form. The foil (8) is structurally independent from the transom (1.1), that is, the foil (8) does not contact directly with the transom (1.1). The foil (8) is formed by combining a plurality of foil members as disclosed in U.S. Pat. No. 13/341,446 by screwing bolts through the foil connection holes (8.1).

Figure 7:
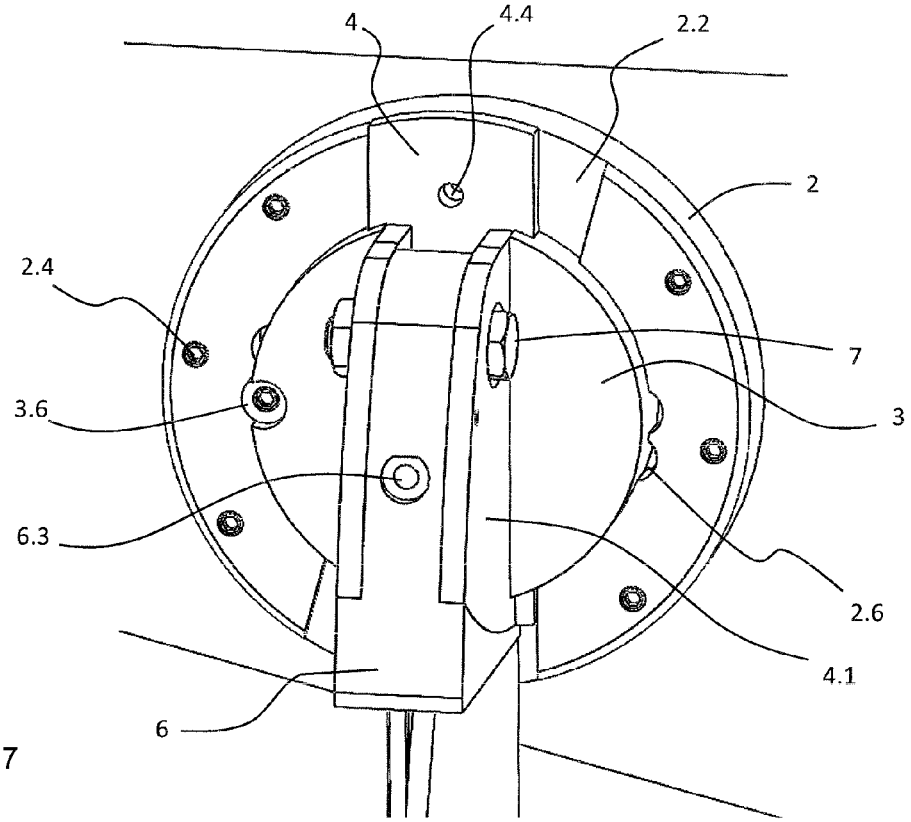
FIG. 7, a closer view of the connecting member of the trim stabilizer device is provided.

For the assembling the trim stabilizer device, the disc (3) is placed in the opening (2.7) of the connecting member (2). While this placement is being conducted, it is provided that the disc guide groove (3.2) is aligned with connecting member guide groove (2.2). At the same time, the second disc fitting hole (3.5) is provided to overlap with one of the disc fitting grooves (2.6); and is fixed to the disc (3) connecting member (2) by member of a disc fixing bolt (3.6) as shown in FIG. 7.

The case guide connection part (6) is inserted between the sliding member side walls (4.1), and therefore the connecting member bearing hole (6.1) is aligned with side wall bearing holes (4.2), and by member of a rotating bearing that is provided to these holes (6.1, 4.2), the case guide connecting member is rotatably supported to the sliding member (4). This bearing is fixed from two opposite ends by member of bearing connection bolt (7). In this case, the connecting member guide connection hole (6.3) is aligned with a sliding member fixing hole (4.4).

In a position where a desired sliding member fixing hole (4.4) corresponds to a first disc fixing hole (3.4) by sliding the sliding member (4) from the connecting member guide groove (2.2) and the overlapping disc guide groove (3.2), the case guide connecting member (6) and sliding member (3) are fixed to the disc (3) following to a bolt is fitted into the connecting member guide connection hole (6.3). Preferably, the actuator case (5) and the actuator (9) are communicated with the foil (8) as it is described above. Afterwards, the actuator case (5) is communicated with case guide connecting member (6) by member of connecting member case connection dents (6.6).

In order for the actuator (9) and therefore the foil (8) to be fixed with a translatory motion in relation to the transom (1.1) or to the bottom edge of the transom (1.3), the sliding member (4) is provided to slide in the disc guide groove (3.2) and connecting member guide groove (2.2). Therefore, the bolt that has been fitted to the connecting member guide connection hole (6.3) is removed from the first disc fixing hole (3.4), and the guide groove (4) is slid. Afterwards, the sliding member fixing hole (4.4), to which the bolt has been fitted, is aligned with the desired first disc fixing hole and fixed with bolt.

Figure 2:
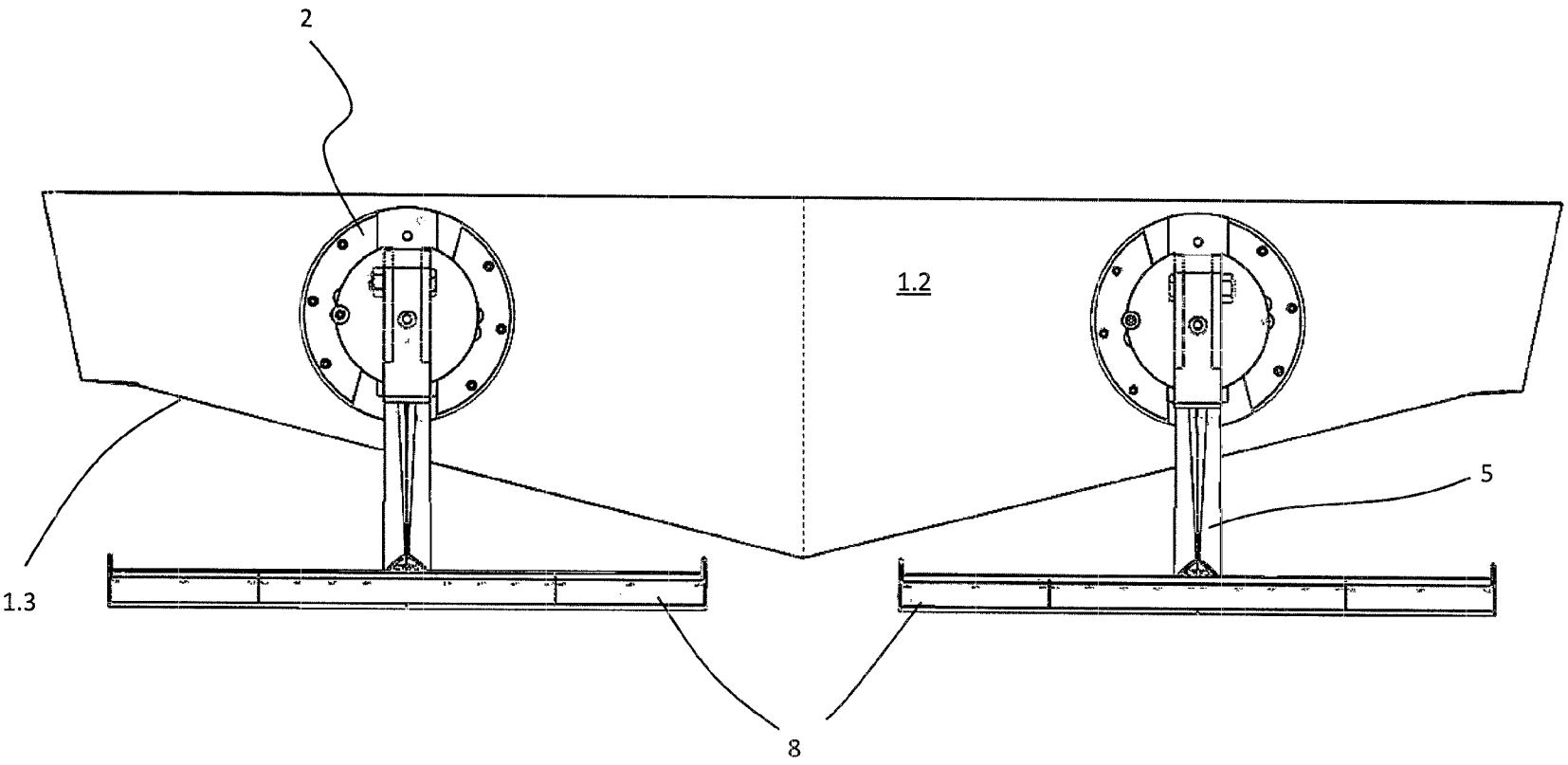
FIG. 2 is the rear view of FIG. 1.
Figure 3:
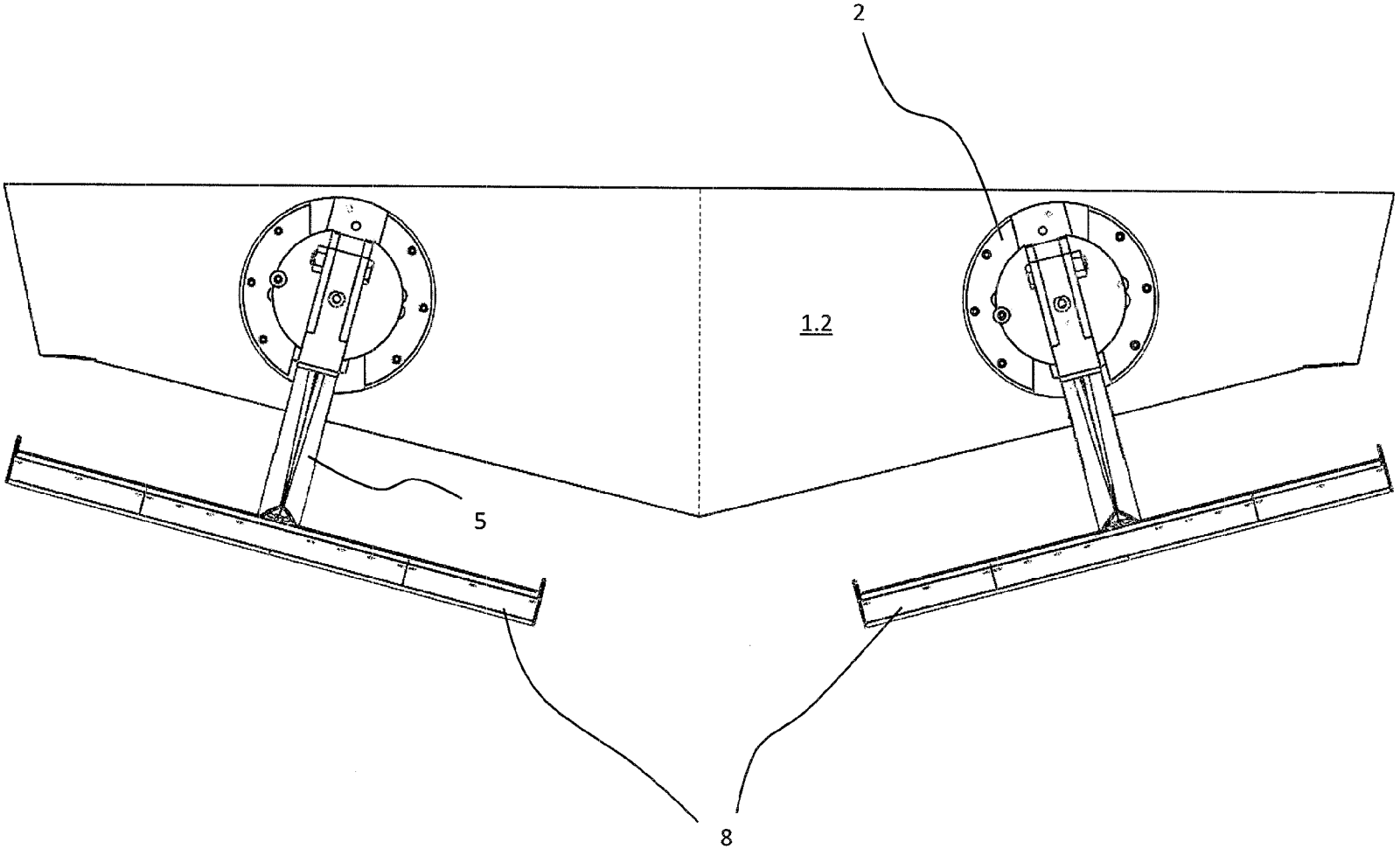
FIG. 3, a pair of trim stabilizers in a rotated position is shown.
Figure 4:
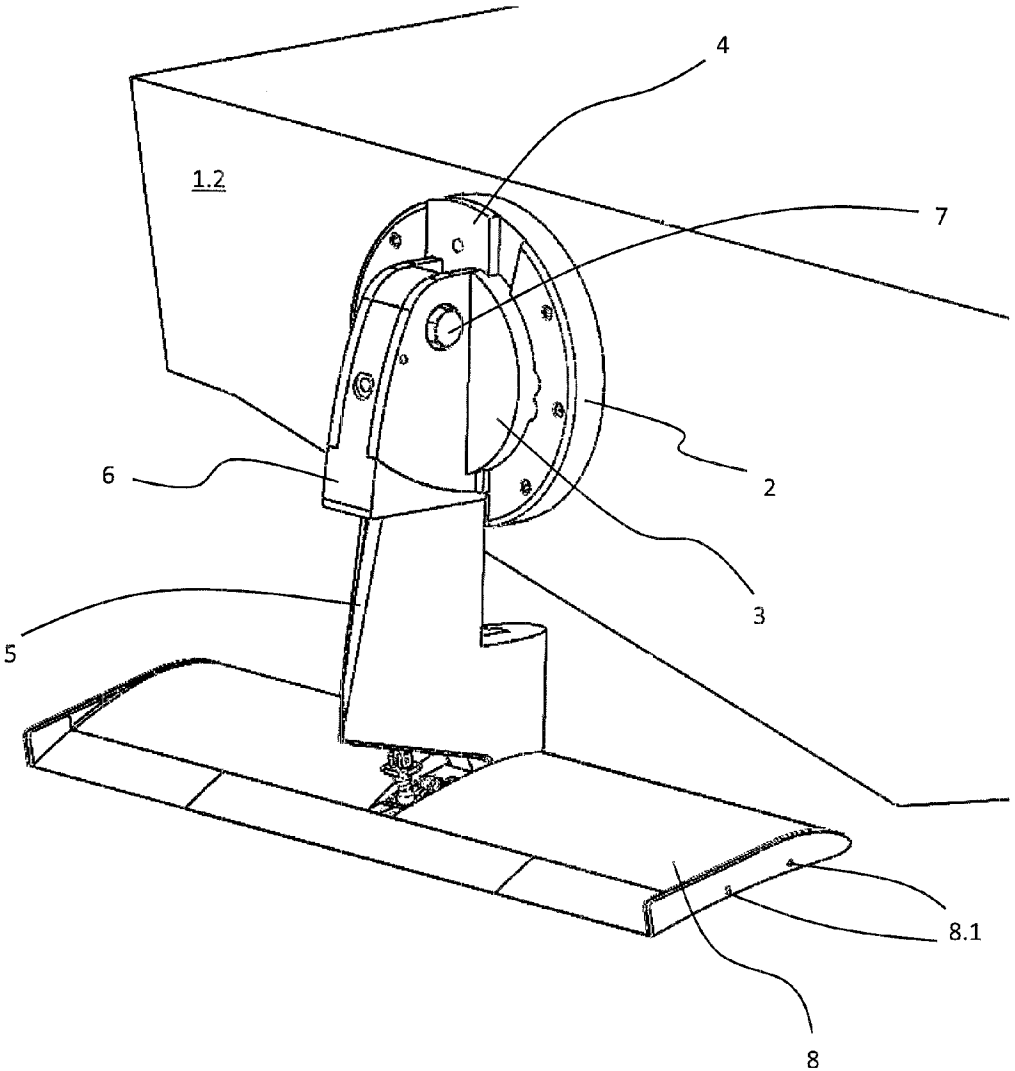
FIG. 4, a closer view of a trim stabilizer device is shown.
Figure 5:
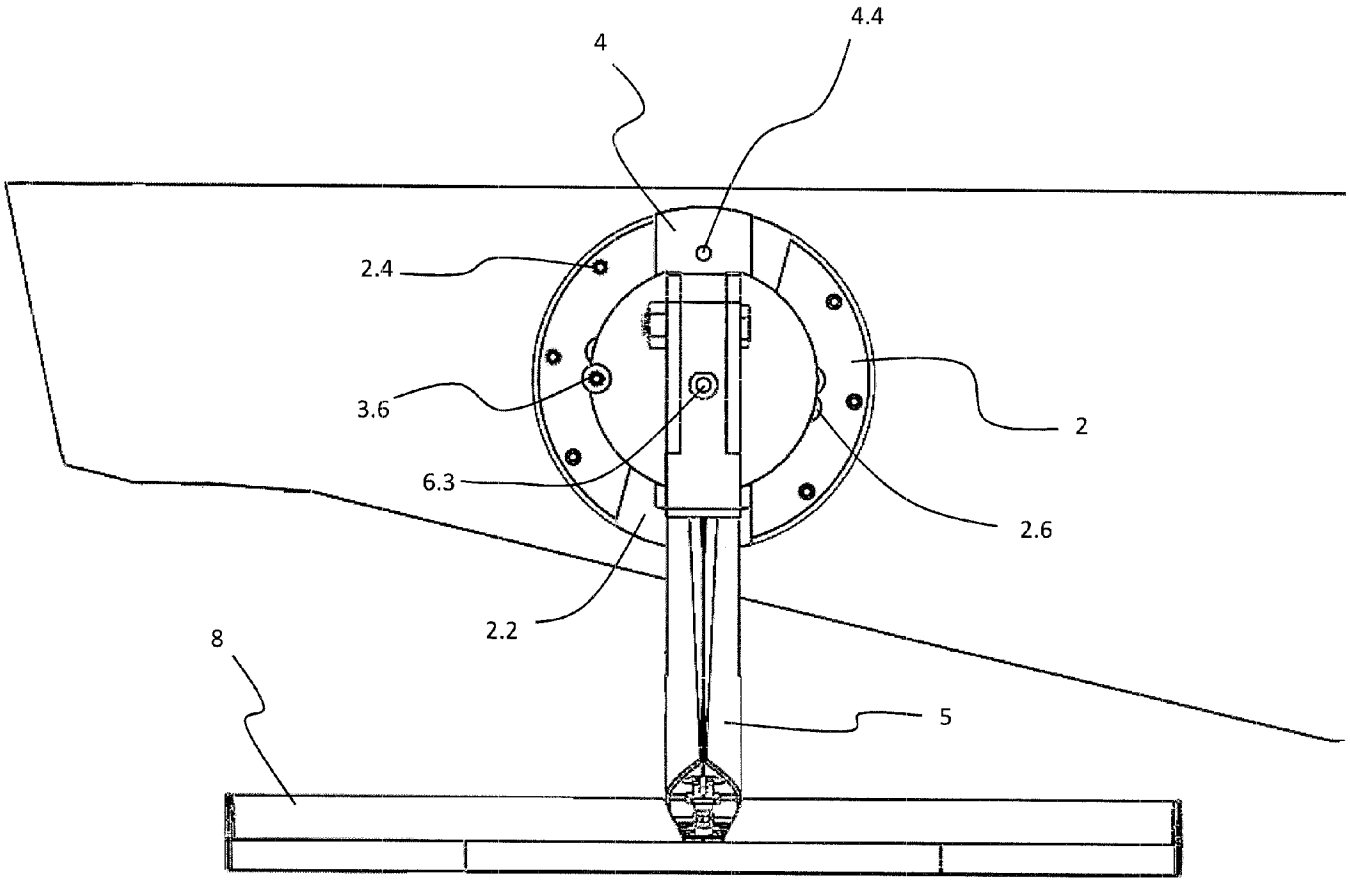
FIG. 5 is the back view of FIG. 4.
Figure 6:
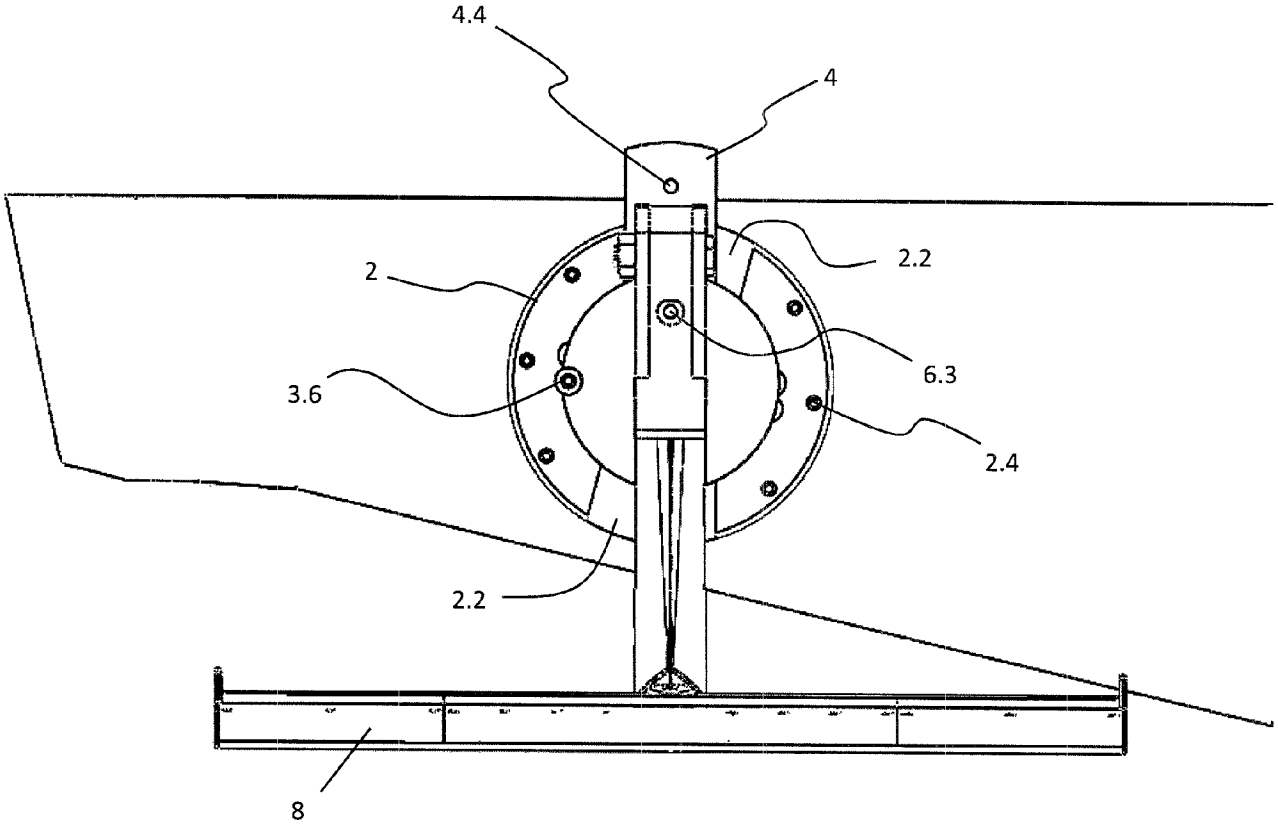
FIG. 6, a view of the trim stabilizer device taken to an upper position translated relative to the transom.

It is also provided that the foil (8) and therefore the actuator (9) make a tilting motion relative to the transom (1.1) and fixed. For instance, in order to shift the position of the foil shown in FIG. 2 to the foil position in FIG. 3, the disc fixing bolt (3.6) is removed, and the disc is tilted relative to the connecting member (2) by applying force (for instance manually) to the actuator case (5) from its sides; and the second disc fixing hole (3.5) is aligned with some other disc fixing groove (2.6) and fixed by member of a bolt. In order for the disc (3) to tilt relative to the connecting member (2), the diameter of the disc projection (3.7) is sized slightly smaller than the diameter of the disc fitting housing (2.5).

The trim stabilizer device according to the present invention further comprises an arrangement to keep the foil (8) out of water. This provides a secure navigation for the boat especially on very shallow water when the foil (8) is taken out of water. As shown in FIG. 18, the foil (8) is taken out of water by lifting the case guide connecting member (6) up, and as it is mentioned above, the case guide connecting member (6) is rotatably supported to the side walls (4.1) of the sliding member. However, before the case guide connecting member (6) is lifted up, a pin that has been passed through the side wall pin holes (4.3) and the pin hole (6.2) at the rear part of the case guide connecting member that is aligned with them is removed. Then, the case guide connecting member (6) is lifted up, and the connecting member pin hole (6.2) on the front part of the case guide connecting member (6) is aligned with the pin holes (4.3) of the side walls, and in this position, a pin is inserted and a fixing is performed as in the case of the foil that is taken out of water as in FIG. 18.

In a typical application of the trim stabilizer device to a motor boat, two separate trim stabilizer devices are symmetrically mounted to the transom (1.1) of the motor boat. The vertical symmetry axis (1.4) of the transom (1.1) can be taken as a reference for achieving the symmetric mounting of the trim stabilizer devices.

This completes the description of the preferred and alternate embodiments of the invention. Those skilled in the art may recognize other equivalents to the specific embodiment described herein which equivalents are intended to be encompassed by the claims attached hereto.

What is claimed is:

1. A trim stabilizer device to be communicated with a transom (1.1) of a motor boat (1), comprising a foil (8) being tiltable around its transversal axis and the foil being structurally independent from the transom (1.1); an actuator (9) communicating with the foil (8) for tilting thereof; a slide member (4) communicating with the actuator (9) for making a translatory motion thereof relative to the transom (1.1); a disc (3) having at least one guide groove (3.2) for guiding the slide member (4); a connecting member (2) for connecting the trim stabilizer device to the transom (1.1), the connecting member communicating with the disc (3).

2. The device according to claim 1, wherein the connecting member (2) comprises a disc fitting housing (2.5) for the said disc (3) to be rotatably communicated with the connecting member (2).

3. The device according to claim 1, wherein the connecting member (2) comprises oppositely formed guide grooves (2.2) having a form of circular segment, the guide grooves (2.2) being alignable with the disc guide groove (3.2).

4. The device according to claim 1, wherein the sliding member (4) comprises a plurality of sliding member fixing holes (4.4) extending linearly; and the disc guide groove (3.2) comprises a plurality of first disc fixing holes (3.4) extend linearly.

5. The device according to claim 4, wherein the connecting member guide groove (2.2) comprises a plurality of slide fixing holes (2.3), at least one of slide fixing holes (2.3) being in an annularly offset position compared to the one other hole.

6. The device according to claim 4, further comprising a case guide connecting member (6) rotatably communicated with the sliding member (4) by member of a rotating bearing.

7. The device according to claim 6, further comprising an actuator case (5) having an actuator (9) and being communicated with the case guide connecting member (6).

8. The device according to claim 6, wherein the sliding member (4) comprises side walls (4.1) extending outwardly from the sliding member (4).

9. The device according to claim 4, wherein the case guide connecting member (6) comprises a connection hole (6.3), the connection hole (6.3) being alignable with one of the sliding member fixing holes (4.4) for securing by a bolt.

10. The device according to claim 2, wherein the disc (3) comprises a disc projection (3.7) extending in the axial direction and having a smaller diameter than that of the disc (3); and the disc projection (3.7) further comprising a second disc fixing hole (3.5) formed in the periphery of the disc projection (3.7).

11. The device according to claim 10, wherein a annular opening (2.7) is provided in the center of the connecting member (2) for having the said disc projection (3.7); and disc fixing grooves (2.6) being provided on the outer diameter periphery of opening (2.7), the disc fixing grooves (2.6) being alignable with the second disc fixing hole (3.5) for securing by a bolt.

12. The device according to claim 11, wherein there are provided separate disc fixing grooves (2.6), one disc fixing groove being placed 180° opposite another of the other disc fixing groove.

13. The device according to claim 8, wherein the sliding member side walls (4.1) comprise side wall pin holes (4.3) formed oppositely along the thickness thereof; and the case guide connecting member (6) comprising separate connecting member pin holes (6.2) being alignable with the said side wall pin holes (4.3).

14. The motor boat having a transom (1.1) comprising two trim stabilizer devices according to claim 1, the two trim stabilizer devices being symmetrically communicated with the transom (1.1) of a vertical symmetry axis thereof.

* * * * *